United States Patent [19]

Worwa

[11] Patent Number: 4,571,771

[45] Date of Patent: Feb. 25, 1986

[54] SWEEPER WITH FIRE CONTROL

[75] Inventor: Richard G. Worwa, Robbinsdale, Minn.

[73] Assignee: Tennant Company, Minneapolis, Minn.

[21] Appl. No.: 644,615

[22] Filed: Aug. 27, 1984

[51] Int. Cl.[4] ..... A47L 11/24

[52] U.S. Cl. ..... 15/319; 15/339; 15/340; 15/347; 55/217

[58] Field of Search ..... 15/319, 339, 340, 347; 55/217

[56] References Cited

U.S. PATENT DOCUMENTS

| | | | |
|---|---|---|---|
| 2,715,452 | 8/1955 | Kent | 15/319 X |
| 3,232,030 | 2/1966 | Owenmark | 15/319 X |
| 3,304,572 | 2/1967 | Wendel | 15/340 |
| 3,695,006 | 10/1972 | Valbona et al. | 15/319 X |
| 3,984,735 | 10/1976 | Schwartz | 15/339 X |
| 4,007,026 | 2/1977 | Groh | 55/302 |
| 4,328,014 | 5/1982 | Burgoon et al. | 55/300 |

*Primary Examiner*—Chris K. Moore

*Attorney, Agent, or Firm*—Kinzer, Plyer, Dorn & McEachran

[57] ABSTRACT

This is concerned with an improved fire control arrangement for controlling a fire caused by a lighted object, such as a cigarette, being swept into the debris chamber of a power sweeper having a vacuumized dust control system.

17 Claims, 7 Drawing Figures

SWEEPER WITH FIRE CONTROL

SUMMARY OF THE INVENTION

This invention is concerned with a fire control arrangement for a sweeper.

A primary object of the invention is a greatly simplified fire control arrangement for a power sweeper having a vacuumized dust control system.

Another object is a fire control procedure which protects parts of the sweeper that will or may be damaged by a fire, for example, the filter element, any plastic components in and around the hopper, etc.

Another object, is a fire control arrangement which does not add appreciably to the cost of the unit.

Another object is a sweeper of the above type which has a temperature sensing device in the air exhaust system, which, when it senses that the temperature of the exhaust air has risen to a predetermined level, initiates a fire suppression or control procedure.

Another object is a fire control arrangement in a sweeper of the above type which indicates to the operator that there is the possibility of a fire in the hopper.

Another object is a fire control arrangement which, when the temperature in the exhaust system reaches a certain level, turns off the vacuum fan and also possibly the sweeper main brush.

Another object is a fire control for a sweeper of the above type which breaks the connection between the vacuum fan and the debris hopper.

Another object is a fire control for a sweeper of the above type which reduces service problems.

Another object is a fire control for a sweeper of the above type which is fully automatic.

Another object is a fire control system for a sweeper of the above type which, when it senses that the temperature in the exhaust system is too high, shuts down all power on the unit.

Another object is a fire control for a sweeper of the above type which uses a dump door across the rear of the hopper and, when it senses that the exhaust air to or through the fan is too high, closes the dump door on the hopper, thereby sealing it off and smothering the fire.

Another object is a fire control for a sweeper of the above type which, when it senses that the temperature in the exhaust system is at a predetermined level, moves the hopper slightly away from the machine thereby breaking the vacuum connection of the exhaust system to the hopper and thus stopping the flow of air through the hopper.

Another object is a fire control system for a sweeper of the above type which by controlling a hydraulic circuit will provide for stopping the sweeping brush and vacuum fan when the temperature in the exhaust system is sensed as being too high.

Another object is a fire control system for a sweeper of the above type which protects the filter, the filter shaker and its associated wiring.

Another object is a fire control for a sweeper of the above type which avoids a restriction in the air flow between the debris chamber and filter.

Another object is a fire control system on a sweeper of the above type which, when a fire is sensed, shuts down the main brush and vacuum fan but leaves power on the wheels so that the operator may drive to a safe place and dump the hopper.

Another object is a fire control system of the above type which, once it has been activated, requires resetting.

Another object is a fire control system for a sweeper of the above type which does not require replacement parts for resetting.

Another object is a fire control for a sweeper of the above type in which a thermostat senses abnormally high temperatures resulting from a fire in the debris hopper and automatically causes appropriate machine functions to occur that control the fire and alert the operator.

Another object is a fire control system for a sweeper of the above type which uses commercially available components.

Other objects will appear from time to time in the ensuing specification and drawings.

DESCRIPTION OF THE PREFERRED EMBODIMENT

Figure 1:
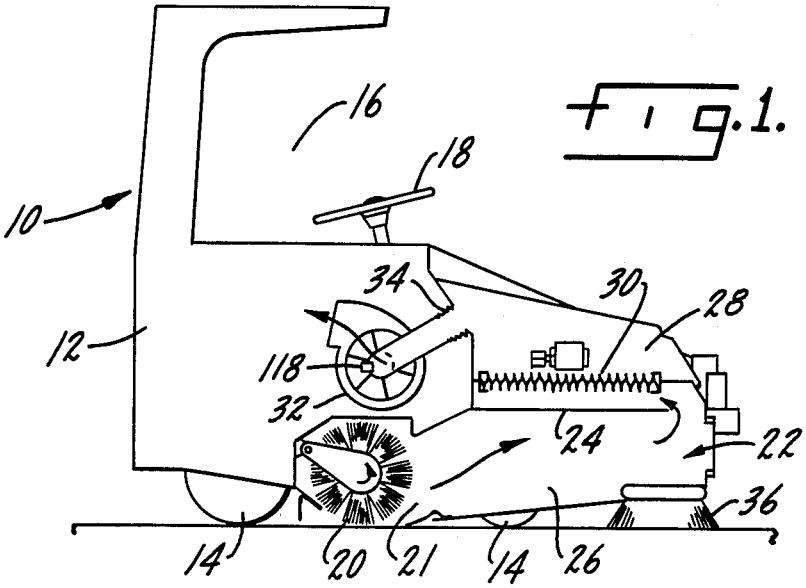
FIG. 1 is a side view schematic of a sweeper with the invention.

In FIG. 1, a sweeper has been shown in outline generally at 10 with a frame 12 on wheels 14 and an engine, not shown, so that it is self-propelled in the usual manner. It is a rider type unit with the operator having a seat or compartment 16 and various controls 18.

A main brush 20 is disposed laterally across the unit and rotates counterclockwise in FIG. 1 so that it propels debris forwardly through an inlet opening 21 into a trash bin or hopper 22 which may be either a low dump or high dump unit. The outline in FIG. 1 is characteristically that of a high dump sweeper. A baffle 24 generally divides the hopper into a lower trash compartment 26 and an upper filter compartment 28 which has a suitable filter, diagrammatically indicated at 30 of the pleated paper variety but it may be any of several other common types. A vacuum fan 32 of any suitable type exhausts air from the trash hopper through a suitable connection 34 which, in this case, is shown at a point remote from the inlet 21 for the hopper.

The unit is also shown with a side brush 36 often referred to as a gutter brush which is rotated so as to move trash and debris from the side to in front of the unit so that the main brush 20 will then throw the debris into the hopper.

The vacuum fan 32 is conventionally used to create a vacuum in the hopper so that air will be drawn in under the skirts around the main brush and will carry dust that is stirred up by the main brush through the hopper inlet 21 so that the dust will not escape. The dusty air is pulled through the filter 30 by the fan and then clean air is exhausted to the atmosphere.

Figure 3:
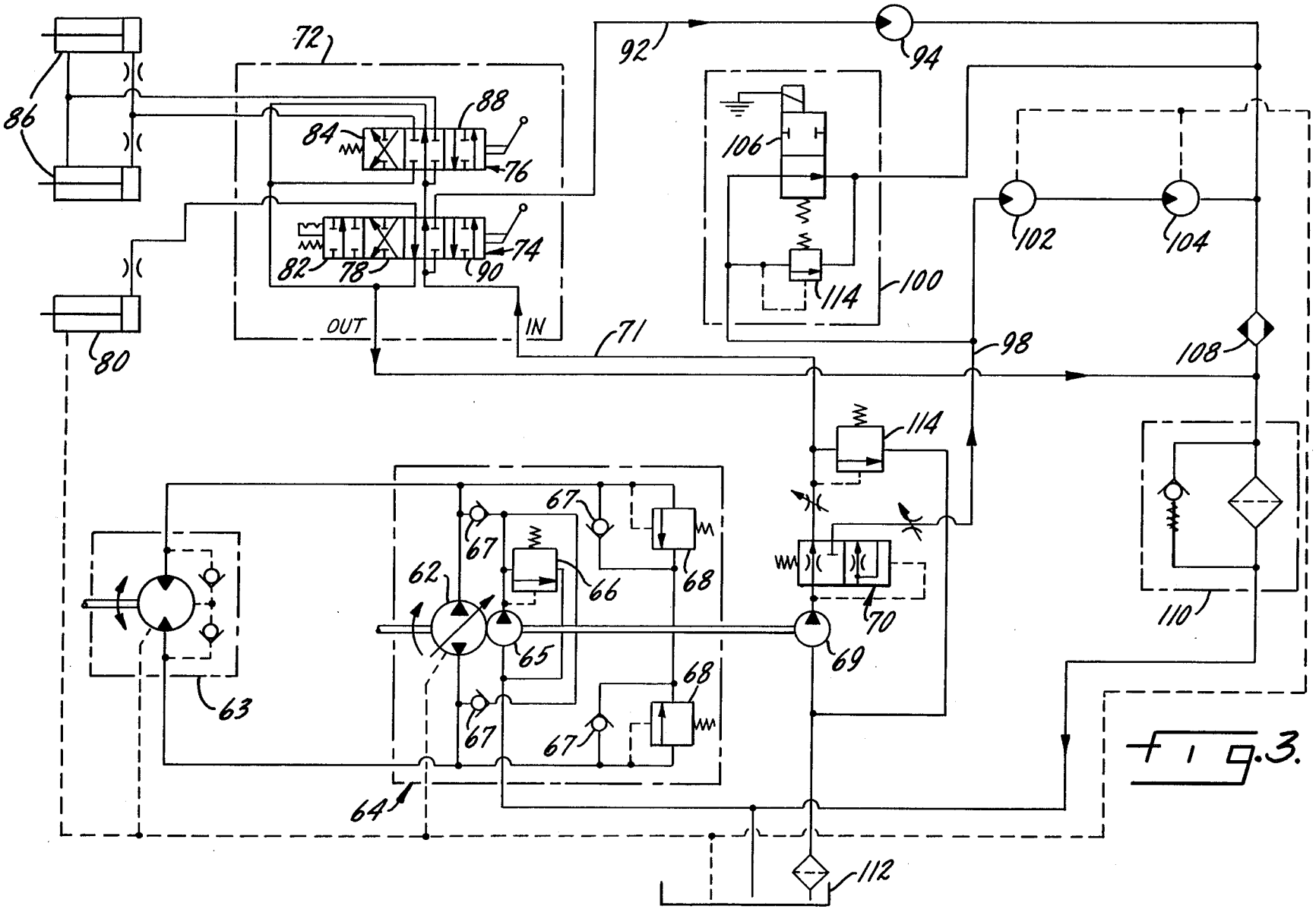
FIG. 3 is a hydraulic circuit.

In the hydraulic circuit diagram in FIG. 3, a variable displacement reversible pump 62 driven by the engine is connected by a closed loop circuit to a fixed displacement motor 63 on the rear drive wheel 14 in a conventional manner. The entire unit 64 as shown enclosed by phantom lines may be a conventional commercially available hydrostatic transmission pump unit, comprised of variable displacement reversible pump 62, charge pump 65 with associated low pressure relief valve 66, four check valves 67 and two high pressure relief valves 68. A fixed displacement pump 69 is also driven by the engine and supplies hydraulic fluid for the various other components. Fluid from pump 69 passes through a priority flow control valve 70 to be explained later, through line 71 to a main control valve unit 72 which has a first manually operated valve 74 shown in the neutral position where it supplies fluid to a second manually operated valve 76. In position 78, first valve 74 operates a hopper lift cylinder 80. Position 82 on the first valve will hold the hopper in lifted position and also pass fluid through to valve 76. When the second valve 76 is in position 84, it supplies fluid to a pair of hopper rollout cylinders 86 if the unit is a high dump system. Position 88 on the second valve reverses the rollout cylinders 86 and causes the hopper to roll back. Position 90 on the first valve sends fluid through a line 92 to a motor 94 that operates the side brush 36. Neutral position as shown on valve 74 will shut off the side brush motor.

The priority flow control valve 70 operates in a conventional manner. It serves to direct a constant flow of fluid though line 71 to side brush motor 94 regardless of excess flow from pump 69 within the limits of the device. The excess fluid is directed through line 98 to main brush motor 102 which operates main brush 20 shown in FIG. 1 and to vacuum fan motor 104 which operates vacuum fan 32 shown in FIG. 1. Thus when engine speed is increased, the speed and fluid output of pump 69 will increase. The flow through line 71 will remain constant and the increased flow will pass through line 98 and increase the speed of main brush motor 102 and vacuum fan motor 104. A selector valve 100 is in parallel with main brush motor 102 and vacuum fan motor 104. The selector valve 100 may include a solenoid operated valve 106 which, when the solenoid is energized, moves valve 106 to blocking position so that the main brush motor 102 and vacuum fan motor 104 are operated. The solenoid may be controlled, for example, by a toggle switch on the dashboard, operated by the driver, to start or stop the main brush and vacuum fan. A cooler 108 and filter 110 in the return line as well as the reservoir or sump 112 are shown and may be conventional. Two high pressure relief valves 114 may be installed for protection against excess pressure in lines 71 and 98.

Figure 2:
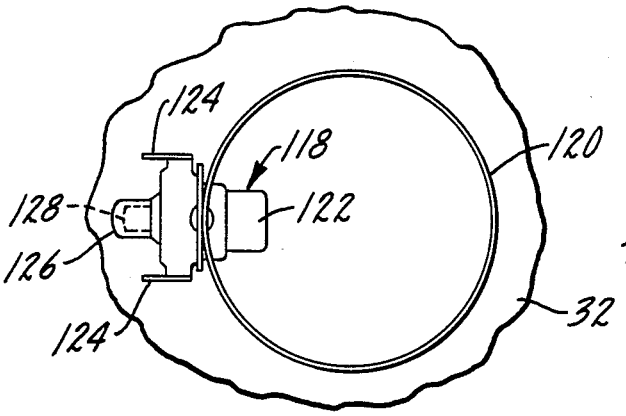
FIG. 2 is an enlarged detail of the fan inlet duct in the exhaust system shown in FIG. 1.

In FIG. 1, a thermostat has been indicated generally at 118 and is shown as positioned in the inlet to the vacuum fan 32. In the enlargement in FIG. 2, the inlet 120 to the vacuum fan is shown with the thermostat 118 having a heat sensor portion 122 disposed in the fan inlet with electrical connections 124 on the outside and a soft plastic cap 126 for waterproofing enclosing a reset push button 128. The thermostat may be a conventional commercially available type with manual reset and which is waterproof to withstand the work environment.

Figure 4:
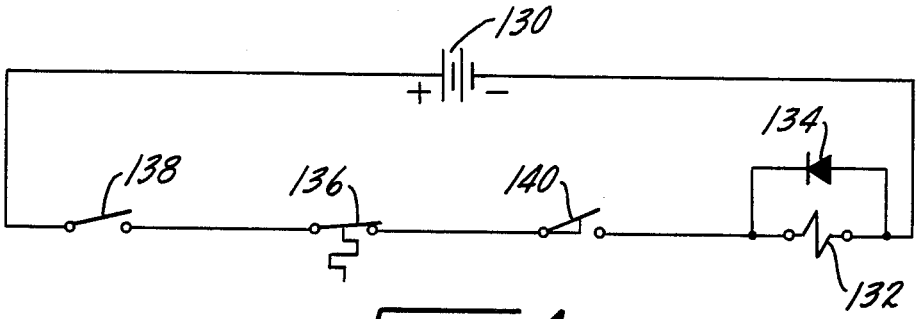
FIG. 4 is a schematic electric circuit.

A simplified electrical circuit is shown in FIG. 4 and includes a battery 130 connected to a solenoid 132 that operates the bypass valve 106 in FIG. 3. The solenoid may have a diode 134 placed across it to relieve a current surge that builds in the solenoid as the field collapses when the current is shut off, which may be conventional. A heat sensor switch 136 in the thermostat 118 responds to the heat sensor 122 in the fan inlet to open the circuit when the heat sensor in the fan inlet detects a certain predetermined temperature. The circuit may also have a toggle switch 138 on the dashboard of the sweeper 10, which may be operated by the driver, to start or stop the main brush and vacuum fan, i.e., by opening or closing the valve 106 by means of its solenoid 132. The circuit may also have a switch 140 which may be, for example, a mercury switch that is operated in response to movement of some of the operating parts. For example, switch 140 is normally closed and is mounted on one of the hopper lift arms, not shown, but is held open by the lift arms. If the driver inadvertently starts to raise the hopper to dump it without shutting off the brush and fan first, the switch will open and de-energize solenoid 132 opening valve 106 and hydraulically bypassing the brush and fan motors so that they automatically stop.

As so far explained, the temperature sensor 122 in the fan inlet will sense when the temperature has gotten too high, meaning that there is a fire in the debris hopper 26 and, in response thereto, will open the switch 136, thereby opening solenoid valve 106 which allows the fluid from pressure line 98 to bypass the main brush motor 102 and vacuum fan motor 104. When the vacuum fan in particular is stopped, and also the main brush, the air current through the hopper will be reduced to or almost to zero which will smother or greatly reduce the effects of a fire.

While the location of the thermostat is preferably in or a part of the fan inlet, it should be understood that it may advantageously be used in the fan outlet or in some restricted area associated with or concerned with the ductwork between the filter and fan where the airflow will be concentrated in a relatively small cross-section and the reaction of the thermostat will be sensitive. Putting it in the fan outlet has the factor that the fan itself will raise the temperature of the air somewhat but the thermostat can be compensated for this slight increase in temperature. It is, however, considered important to put the thermostat at a point or in a position where the airstream is concentrated and the entire airflow passes near the heat sensor.

Figure 5:
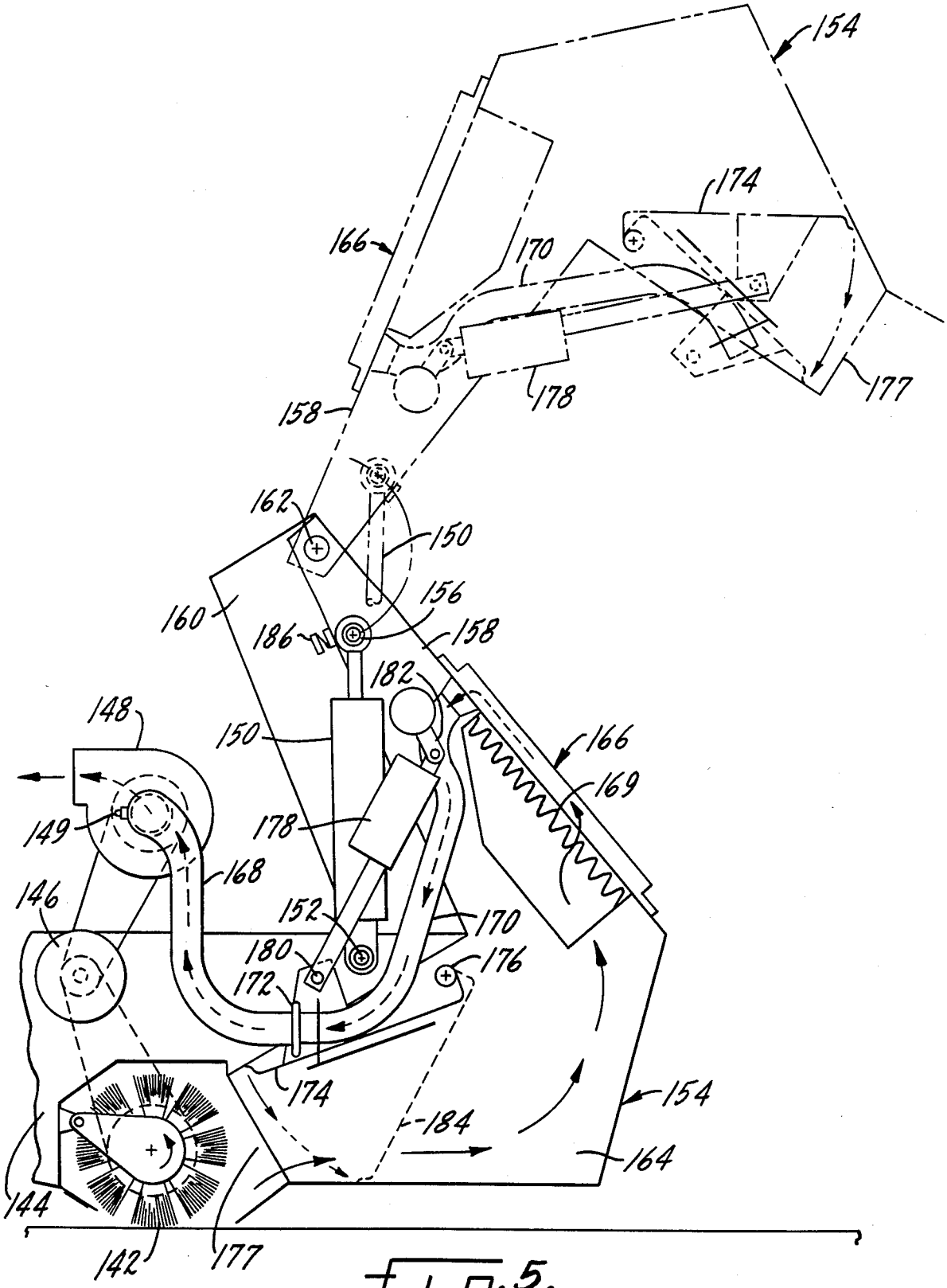
FIG. 5 is a schematic of another sweeper which uses a modified form of the invention.

In FIG. 5 a variant form has been shown in which a main brush 142 is mounted on the frame 144 of the sweeper and is shown as driven by a suitable belt drive from an engine 146 with a vacuum fan 148 and a thermostat 149 in the inlet, the fan being shown diagrammatically also as belt driven. One or more hydraulic cylinders 150 corresponding more or less to the hopper lift cylinder 80 in FIG. 3, are pivoted on the main frame as at 152 and, when extended, raise the hopper 154 to the position shown in phantom in FIG. 5. The lift cylinder or cylinders 150 are pivoted at their upper ends as at 156 on lift arms 158 which are also pivoted on uprights 160 as at 162 on the main frame.

The hopper has a debris chamber 164 and a filter chamber 166 shown generally in FIG. 5. And it will be understood that they are constructed and arranged so that the fan 148 tends to draw a vacuum through a connection tube 168 to the filter chamber which may contain a pleated paper element 169. Debris is thrown forward into the hopper and dust is drawn through the filter and through a tube 170 which connects to the tube 168. The fan 148 sets up an airflow through the filter chamber 166 and paper element 169, through the connection tubes 170 and 168 and then through the fan and out the fan exhaust. Dirty air is shown in solid lines and clean air in broken lines. The end 172 of the fan conduit 168 has a large annular seal of rubber or rubber-like material which abuts or seals against the end of conduit 170 when the hopper is fully lowered, therby communicating the vacuum to the filter chamber.

The hopper may be provided with a rear door 174 pivoted at 176 on the hopper which, in its raised position shown in full in FIG. 5, is above the debris inlet 177 of the hopper and in fact, forms the upper surface or ceiling for the inlet tending to guide material thrown forward by the brush into the hopper. The rear door is operated by a suitable actuator 178 which is pivoted at one end, as at 180, to the door or a bracket on the door, and at its other end on a suitable mounting 182 on the hopper. Upon actuation the rear door 174 will close to the dotted line position 184 to effectively block off the rear opening and thereby seal off or close the hopper. In its preferred form, the actuator 178 is electrical and the main purpose of the rear door, when closed, is to keep the debris in the hopper while the hopper is being raised to dump height, shown in phantom lines in FIG. 5, and then to open and let the debris fall out, for example, into a collecting bin.

In the arrangement shown and described, when the thermostatic switch 149 detects a certain predetermined temperature in the airstream, i.e. a fire in the hopper, it may also energize a relay to operate the actuator 178 to close the dump door 174 thereby shutting off the hopper. The same relay, not shown, may also by means of a solenoid valve cause the lift cylinders 150 for the hopper to be actuated to start the dumping movement. There may also be a limit switch 186 mounted on the lift arms 158 which is constructed and arranged to stop the lifting action, i.e., de-energize the hydraulic lift cylinders 150 when the hopper is moved a few inches into the lift cycle. This will break the air flow connection at 172 between the fan 148 and the filter chamber tube 168 and tube 170 which will stop the airflow through the hopper. This stopping of the airflow will greatly minimize or subdue the fire. At the same time, this does not require the fan and brush be stopped since they are belt driven by the engine which, if it was shut down, would keep the operator from driving the machine to a safe place to dump the fire.

While the unit in FIG. 5 has been shown as a high dump unit, it should be understood that it could also be a low dump unit. And the limit switch 186 would stop the lifting action after a few inches of movement thereby breaking the air connection at 172 to the hopper and filter chamber.

Figure 6:
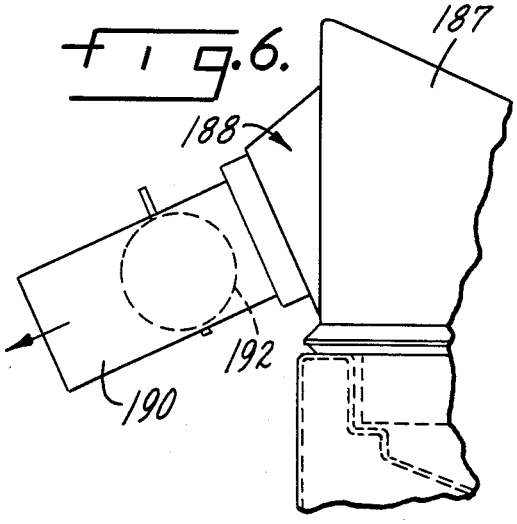
FIG. 6 is a fragmentary view of a modified form.

In FIG. 6 a further variant has been shown in which the inlet to the fan from the filter chamber 187 is indicated generally at 188 which may be assumed to be the same as or the equivalent of the connection 34 in FIG. 1 or something like connection 168 in FIG. 5. In any event, 188 generally represents the inlet to the fan coming from the filter chamber 187. This passage or connection 188 has a duct 190 with a butterfly valve 192 or the like in it controlled by a suitable solenoid, not shown.

The sweeper is of the type that when the unit goes into its dump cycle the butterfly valve 192 is automatically closed to prevent foreign objects from entering the fan while the hopper is raised and the air passage to the fan is exposed. This butterfly valve may be given the added function of aiding in the control of fires in the hopper by connecting its solenoid with the thermostat 118 so that when an abnormally high temperature is sensed, the butterfly valve 192 will be closed thus shutting off the airflow through the hopper and filter.

Figure 7:
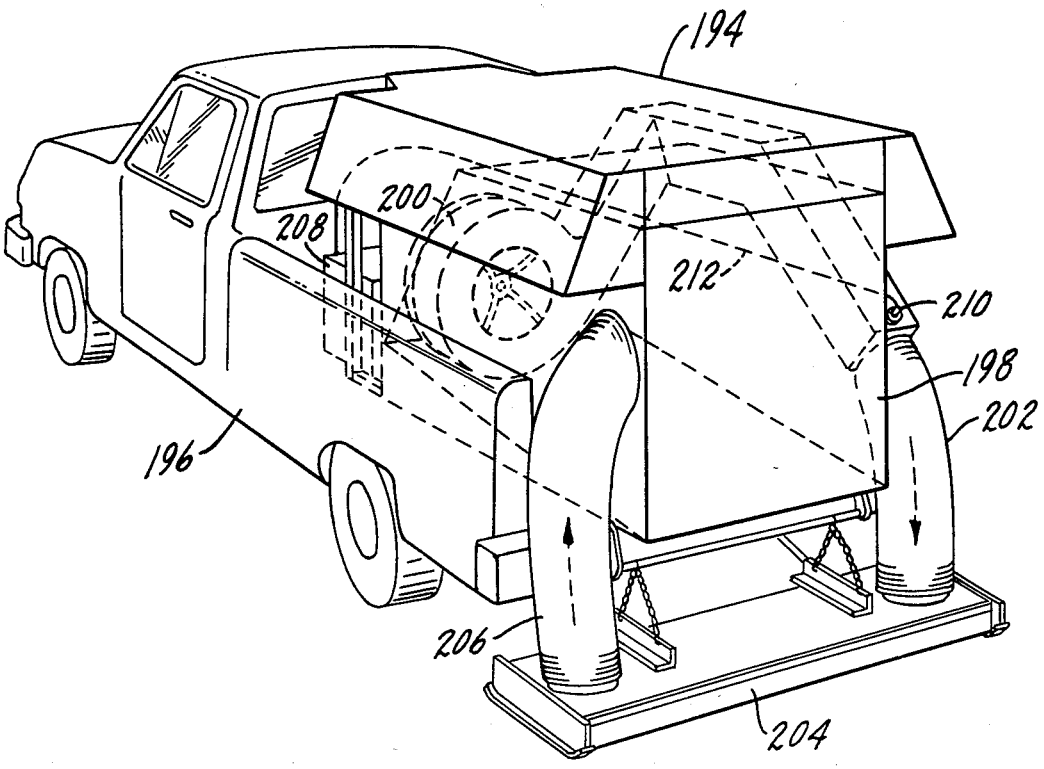
FIG. 7 is a perspective of a further variant.

In FIG. 7, a further modification has been shown in which a sweeper or vacuum unit 194 is mounted on and carried by a conventional truck 196 or the like. The sweeper includes a chamber or housing 198 with a fan 200 at or adjacent its forward end, although it may be positioned anywhere, to supply an air current through an outlet tube or duct 202 to a pick-up head 204 with a return duct or tube 206 to the side of the housing to therby create an enclosed continuous cyclonic effect. The fan is either direct or belt-driven by a suitable engine 208 or the like. The air that moves down duct 202 will pass across pick-up head 204 and in so doing will remove debris from the surface beneath pick-up head 204. Then the movement of air up return duct 206 will lift this debris and deposit it in the body or hopper 198 of the sweeper.

A suitable thermostat 210 of the type explained previously may be positioned in the outlet duct to sense the temperature of the air in the air circulation system. When the temperature rises to a sufficient level indicating that there is probably a fire in the hopper, the thermostat may automatically, through suitable wire connections 212, shut down the engine 208 which will stop the airflow and tend to smother the fire. Also, the noise drop will clearly indicate to the operator that something is wrong. Having the thermostat shut down the engine 208 is merely the simplest form and any of the other venting arrangements, butterfly valve etc., or some combination thereof, might also be used, possibly in modified form.

While the pick-up head has been shown behind the truck, it should be understood that it might be underneath, for example, between the wheels or in any other suitable location, depending upon the details of the vacuum unit and its relationship to the truck and whether it is a detachable unit or a permanent part of the vehicle.

The use, operation and function of the invention are as follows:

The invention is concerned with improved fire control for a sweeper which may be of the forward throw self-propelled type although it is not limited thereto. The problem of a fire and how to control it in the hopper of a sweeper occurs, for example, if a live cigarette gets swept up along with some paper or other flammable debris. Such a fire is stimulated by two sources of air, primarily the exhaust fan, but also the main brush. If such a fire gets out of control, it may cause extensive damage. The filter element, be it a pleated paper unit or otherwise, may well be destroyed. The filter shaker motors and related wiring can also be damaged. Plastics are coming into vogue in machines of this type and they also will burn. Urethane foam has been used to muffle the fan noise by lining the outlet duct with it which will also burn and might cause the fire to be blown into the engine compartment.

The use of some sort of a fire door between the debris and filter chambers in general causes an airflow restriction and is now considered undesirable.

The present solution is to mount a thermostat in the vacuum fan ductwork. The thermostat may be set for any suitable temperature higher than the ambient air temperature that the sweeper will normally encounter. When the thermostat detects whatever temperature it is set for, in all probability, it is in response to or caused by a fire in the debris hopper. In response to this temperature, the thermostat should initiate appropriate controls and/or activities to control and/or suppress the fire.

In the form shown and discussed in connection with FIG. 3, the thermostat actuates a solenoid valve which bypasses oil in the hydraulic system around the fan and brush motors, thus stopping the fan and brush. This will slow down and/or subdue the fire and confine it to the hopper. Additionally, when the brush and fan stop, there is a pronounced drop in the noise level of the machine such that the operator wi11 or should be conscious of it at which point he will know that something is wrong and that he should investigate. In the hydraulic drive shown in FIG. 3, stopping the fan and brush motors does not effect the traction drive. So the operator, when he detects the noise drop, can drive the motor to a safe place and dump the hopper which gets rid of the fire and protects the machine. Additionally, the particular thermostat shown in FIG. 2 has a reset button on it which may be located inside of the engine housing and will require the operator to open a cover or door before he can reset the thermostat and cause the main brush and fan to start again. Having to do this will indeed raise his consciousness to the point that he will know something is wrong, i.e., there is a fire in the hopper. Even the most ardently unconscious will not miss this.

Using a thermostat to sense a hopper fire and initiate automatic protective action may be used in other power sweepers and is not limited to a forward throw unit. For example, it may be used on a smaller walk behind sweeper which is customarily driven by a small air cooled gasoline engine belt connected to drive both the brush and vacuum fan. In such a case the thermostat might be connected into the ignition system so that when it detects a fire in the hopper, it will kill the engine which will stop everything. Then the operator will indeed know that something is wrong. Since it is a small walk behind sweeper, the operator may then push it to a safe place to dump the hopper and get rid of the fire. The invention could also be applied to and would have advantages in an over-the-top sweeper with a rear hopper.

The invention may be applied to either a low or a high dump unit. The arrangements shown in FIGS. 1 and 5 are intended to indicate generally high dump units. In FIG. 5, the hopper has a door across the rear opening which is normally intended to be closed when the unit goes into its high dump cycle to hold the debris in the hopper until it gets up to dump height at which point the door opens, allowing the debris to fall into a container. Again, during a sweeping operation, the thermostat will sense the fire by the increase in the temperature of the air going to the fan which will then close the rear dump door which shuts off the air into the hopper. This will also energize the lift cylinders which will cause them to extend slightly moving the hopper a few inches forward away from the machine frame until a limit switch on one of the lift arms opens to stop the action after sufficient movement has taken place to separate the fan inlet from the filter chamber, i.e., venting the fan inlet to the atmosphere. This will stop any airflow out of the hopper and the fire will probably be smothered because the dump door may be kept closed thereby confining the fire in a totally enclosed space. In this form, the fan and brush would continue to operate as would the engine so that the operator could drive the unit to a safe place to dump the fire.

If the fan and filter chamber are always connected, for example, by a long flexible tube, and do not separate during dumping, the inlet to the fan may be blocked by a butterfly valve or the like, such as in FIG. 6, which will block or stop the suction to the hopper but at the same time will allow the fan to keep running. This may be used in connection with, for example, the rear door on the hopper, such as shown in FIG. 5 which, when a fire is detected, will be closed to help smother the fire. In this form also, the brush and fan may be belt driven from the engine and therefore will not and cannot be stopped without stopping the engine which would leave the operator with no way of moving the machine.

The solenoid valve arrangement that stops the sweeping brush and vacuum fan in FIG. 3 is quite desirable. Closing a dump door to block off the air entering the hopper is also preferred. Opening the ductwork leading from the filter chamber to the fan by lifting the hopper slightly is also desirable. Blocking the duct between the filter chamber and the fan by a butterfly valve or the like as in FIG. 6 is also desirable. Shutting down the engine if the machine is a walk behind unit which may be hand pushed is also advantageous.

In case the sweeper is of the type that has an opening between the debris and filter chambers, a closure could be provided which, in response to the thermostat, would be closed by, for example, a solenoid. This would confine the fire to the debris hopper. At the same time, the fan could be shut down or its inlet could be vented. And, if there is a door on the debris inlet opposite the brush, it could be closed. This would be very advantageous when it is desired to smother the fire quickly, for example, when the hopper is made of plastic and a fire might burn through rather rapidly, as compared to a metal hopper.

While the preferred form and several variations of the invention have been shown, suggested and described, it should be understood that suitable additional modifications, changes, substitutions and alterations may be made without departing from the invention's fundamental theme.

I claim:

1. In a sweeper, a frame, a debris hopper on the frame with an opening for receiving debris, an air exhaust system connected to the hopper including a vacuum fan for exhausting air from the hopper, a power source on the frame for operating the vacuum fan, means for sensing the temperature of the air flowing through the air exhaust system from the hopper, and means responsive to the temperature sensing means in the air exhaust system for indicating when the air temperature in the air exhaust system has reached a predetermined level.

2. The structure of claim 1 further characterized in that the temperature sensing means is in the inlet to he vacuum fan.

3. The structure of claim 1 further characterized in that the indicating means is constructed and arranged to stop the operation of the vacuum fan when the temperature in the air exhaust system has reached a predetermined temperature.

4. The structure of claim 1 further characterized in that the indicating means is constructed and arranged to open the air connection between the hopper and the fan.

5. The structure of claim 1 further characterized in that the indicating means is constructed and arranged to de-energize the drive from the power source to the vacuum fan.

6. The structure of claim 5 in which the sweeper has a generally horizontal rotary brush on the frame for propelling debris from a surface to be cleaned into the hopper, and further characterized in that the indicating means also de-energizes the drive from the power source to the brush.

7. The structure of claim 1 further characterized in that the sweeper has an inlet door on the opening of the debris hopper, and further characterized in that the indicating means is constructed and arranged to close the inlet door on the debris hopper when the air temperature in the air exhaust system has reached a predetermined level.

8. The structure of claim 1 further characterized in that the indicating means is constructed and arranged to de-energize the power source so as to stop the operation of the vacuum fan.

9. The structure of claim 1 further characterized in that the sweeper is a forward throw sweeper with the debris hopper being positioned ahead of a brush and the opening in the hopper is located in the rear thereof for receiving debris propelled forward by the brush.

10. The structure of claim 1 further characterized in that the sweeper is an over-the-top unit with the debris hopper in the rear.

11. The structure of claim 1 further characterized in that the debris hopper is divided into a debris chamber and a filter chamber, an opening between the two chambers controlling the flow of air between the debris chamber and the filter chamber, and means responsive to the temperature sensing means for closing the opening between the two chambers when the air temperature in the air exhaust system has reached a predetermined level.

12. The structure of claim 1 further characterized by and including a conduit between the fan and the hopper in the air exhaust system, and a valve in the conduit constructed and arranged to be closed by the temperature responsive means when the air temperature in the exhaust system has reached a predetermined level.

13. The structure of claim 1 in which the sweeper is of the type having a hopper on a truck and a vacuum fan mounted to exhaust air from the hopper with an air outlet line from the fan outlet connected to a pick-up head adapted to pick up debris from a surface to be cleaned such as a street and an air return line adapted to return air and entrained debris to the hopper, and further characterized in that the temperature sensing means is located in the air outlet line.

14. In a mobile sweeper, a frame, wheels for the frame providing for its movement, a generally horizontal forward throw rotary brush on the frame, a debris receiving hopper on the frame forward of the brush, two chambers in the hopper, one for receiving debris from the brush and another with a filter unit, an opening between the two chambers controlling the flow of air between the debris chamber and the filter chamber, a rear opening in the debris chamber generally opposite the rotary brush adapted to receive debris thrown forward by the brush, an air exhaust system for exhausting air from the hopper including a vacuum fan on the frame connected to the filter chamber, means for sensing the temperature of the air flowing through the air exhaust system from the hopper, and means responsive to the temperature sensing means in the air exhaust system for indicating when the air temperature in the air exhaust system has reached a predetermined level.

15. The structure of claim 14 further characterized in that the indicating means is constructed and arranged to simultaneously close the rear opening of the debris chamber and to vent the exhaust system ahead of the fan when the air temperature in the air, exhaust system has reached a predetermined level.

16. The structure of claim 14 further characterized in that the sensing means is located in the fan inlet.

17. The structure of claim 14 further characterized by and including means responsive to the temperature sensing means for closing the opening between the two chambers.

* * * * *